US010695633B2

(12) United States Patent
Iwanchuk

(10) Patent No.: US 10,695,633 B2
(45) Date of Patent: Jun. 30, 2020

(54) BREAKAWAY TRAINER

(71) Applicant: Dennis M. Iwanchuk, Chestmere (CA)

(72) Inventor: Dennis M. Iwanchuk, Chestmere (CA)

( * ) Notice: Subject to any disclaimer, the term of this patent is extended or adjusted under 35 U.S.C. 154(b) by 93 days.

(21) Appl. No.: 15/909,453

(22) Filed: Mar. 1, 2018

(65) Prior Publication Data

US 2019/0015721 A1 Jan. 17, 2019

Related U.S. Application Data

(60) Provisional application No. 62/467,199, filed on Mar. 5, 2017.

(51) Int. Cl.

| | |
|---|---|
| ***A63B 63/00*** | (2006.01) |
| ***A63B 69/00*** | (2006.01) |
| ***A63B 1/00*** | (2006.01) |

(52) U.S. Cl.

CPC ..... *A63B 63/004* (2013.01); *A63B 1/00* (2013.01); *A63B 69/0026* (2013.01); *A63B 2063/002* (2013.01)

(58) Field of Classification Search

CPC ..... A63B 69/0026; A63B 2063/002; A63B 2063/004; A63B 1/00

USPC ..... 473/446, 471, 478

See application file for complete search history.

(56) References Cited

U.S. PATENT DOCUMENTS

| | | | | |
|---|---|---|---|---|
| 3,840,228 | A * | 10/1974 | Greaney | A63B 63/00 473/446 |
| 3,856,298 | A * | 12/1974 | Frantti | A63B 63/00 473/446 |
| 5,772,538 | A * | 6/1998 | Sztykiel | A63B 63/00 473/446 |
| 2007/0265115 | A1 * | 11/2007 | Farquhar | A63B 63/004 473/446 |

* cited by examiner

*Primary Examiner* — John E Simms, Jr.
*Assistant Examiner* — Rayshun K Peng
(74) *Attorney, Agent, or Firm* — Kyle R Satterthwaite; Ryan W Dupeis; Ade & Company Inc.

(57) ABSTRACT

A breakaway trainer device features a first leg pad mimicking member, a second leg pad mimicking member connected to said second pad-mimicking member; and first and second connectors operable to respectively connect the first and second leg pad mimicking members to first and second posts of a goal net to place the first and second leg pad mimicking members in positions projecting outward from the goal net at a converging angle with one another. The leg pad members feature an optionally adjustable five-hole between their proximal ends, and optionally adjustable scoring holes at their distal ends near the goal posts. Adjustable connectors and/or extendable/collapsible leg pad members enable quick and easy adjustment of the angular positions and forward/rearward reach and placement of the leg pad members to simulated various goaltender positions.

20 Claims, 9 Drawing Sheets

BREAKAWAY TRAINER

CROSS-REFERENCE TO RELATED APPLICATIONS

This application claims benefit under 35 U.S.C. 119(e) of U.S. Provisional Application No. 62/467,199, filed Mar. 5, 2017, the entirety of which is incorporated herein by reference.

FIELD OF INVENTION

The present invention relates to a device that connects to a sporting net and helps improve the user's breakaway skills.

BACKGROUND OF INVENTION

In the field of sports training, it is known to equip a goal net with a training device that partially fills up on the open space of the net to allow an offensive player to work on improvement of their shooting accuracy by aiming for the small areas left unobstructed by the devices. Examples of such devices can be found in Canadian Patent Applications CA1227818 and CA2897759, published U.S. Patent Applications US20070265115, US20090181810, US20140045628, and US20140302949, and granted U.S. Pat. No. 4,489,940, U.S. Pat. No. 4,921,257, U.S. Pat. No. 5,582,404, U.S. Pat. No. 5,772,538, U.S. Pat. No. 7,811,184 and U.S. Pat. No. 9,433,841.

The device in the forgoing references are of two-dimensional structure, and therefore don't protrude into the crease area of the goal net, and therefore don't create an accurate simulation of a three-dimensional goaltender that the user would face in a real-life game situation. U.S. Pat. No. 3,840,228 discloses a training device in the form of a dual-panel structure hung in the goal space from an upper crossbar of the goal net, thus providing a degree of three-dimensional depth, as the two panels converge outwardly from the goal. However, the purpose of the panel is to give surfaces for blocked shots to rebound off of so that the shooter can practice their rebound skills. Accordingly, rather than doing a good job of simulating actual game conditions by accurately approximating all or part of an actual goalie's body and equipment, each panel is of a non-descript generally rectangular shape obstructing a substantial majority of a respective half of the goal net, thereby helping ensure that a first shot will hit the device and deflect therefrom to provide the practicing player with rebound opportunity.

Breakaway skills are a valuable asset in sports such as hockey, particularly in cases where games are being decided by breakaway-style shootout competitions. However, having a real goalie in net for the duration of breakaway practice sections would be tiring, and potentially harmful to the goalie. Accordingly, it would be desirable to provide a device that presents a three-dimensional dimension goalie surrogate particularly suited to simulate breakaway scenarios.

SUMMARY OF INVENTION

According to one aspect of the invention, there is provided a breakaway trainer device comprising:

a first leg pad mimicking member;

a second leg pad mimicking member residing in or movable into a position lying at a convergent angle with said first leg pad, where each of said leg pad mimicking members has a width and length approximating that of a goalie leg pad; and a pivotal, flexible or adjustable connection between said first and second leg pad mimicking members by which the converging angle can be varied, whereby the breakaway trainer is useful in front of a goal net with the first and second leg pad mimicking members in positions projecting outward from the goal net at different converging angles with one another to simulate different goalie positions for breakaway practice.

The leg pad mimicking members, also referred to herein as "leg pad members" in the interest of brevity, occupy a position diverging away from one another starting the near the top of the crease and extending back to the goal posts, thereby imitating a hockey goalie's butterfly position, where the knees are dropped down to ground level and pinched together, and the lower legs diverge rearwardly from the pinched-together knees toward the goal posts. The blade of the goalie's hockey stick (also referred to herein as a goal stick) in placed in front of the goalie's pinched together knees to minimize a "five-hole" space between the goalies legs, while the leg pads worn on the rearwardly angled lower legs of the goalie cover low lying areas behind the goalies torso on either side.

Preferably, there are first and second connectors operable to respectively connect the first and second leg pad mimicking members to first and second posts of aid goal net.

Preferably, the first and second connectors are each adjustable in length to enable variability in (i) a distance by which said first and second leg pad mimicking members project outward from the goal net, and/or (ii) the relative angle between the first and second leg pad mimicking members.

The first and second connectors may comprise adjustable straps.

The first and second connectors may be adjustable straps with hook and loop fastener material.

There may be provided first and second extensions movably mounted to the first and second leg pad mimicking members for selective extension thereof.

In some embodiments, the extensions are narrower than the leg pad mimicking members and are coupled thereto in elevated positions spaced upwardly from bottom edges of said leg pad mimicking members to leave an opening between each leg pad mimicking member and the respective post of the goal net beneath the respective extension.

In one embodiment, each extension is strip-shaped. In another embodiment, the each extension is rod-shaped.

In some embodiments, the first and second extensions have respective slotted connections to the first and second leg pad mimicking members.

Each goalie mimicking pad may have a cut-out therein at a lower corner of a distal end of the leg pad to leave an open scoring hole between the goalie mimicking pad and the respective post of the goal net at said lower corner of the goalie mimicking pad.

In such embodiments, a respective adjustment flap may be movably supported on each goalie mimicking pad adjacent the cut-out at the lower corner thereof, said adjustment flap being movable back and forth over the cut-out to adjust a size of the open scoring hole.

In some instances, there may be a five-hole opening between the first and second leg pad mimicking members above the connection at which the first and second leg pad mimicking members are joined.

In such cases, there may be a five-hole attachment attachable to the first and second leg pad mimicking members to span over the five-hole opening.

The five-hole attachment may be adjustably mountable to the first and second leg pad mimicking members for selectively upward and downward movement thereof to adjust a height of the five-hole opening.

In other instances, there may be a five-hole opening between the first and second leg pad mimicking members below the connection at which the first and second leg pad mimicking members are joined.

There may be one or more pad stacking attachments connected or connectable to the first and/or second leg pad mimicking members in positions standing upward therefrom.

Said one of more pad stacking attachments preferably comprise a blocker attachment and a glove attachment each attachable to a respective one of the pad mimicking members to mimic a goalie glove and a goalie blocker obstructing areas of the goal net above said first and second leg pad mimicking members.

Each pad stacking attachment may be adjustable to vary are adjustable to vary a position occupied thereby when mounted to the pad mimicking members.

Each pad stacking attachment may be height-adjustable to vary a height by which said pad stacking attachment spans upwardly from the first and second leg pad mimicking members.

Each pad stacking attachment may be laterally-adjustable to vary position occupied by said pad stacking attachment along the respective pad member.

When used in combination with the goal net, the first and second leg pad mimicking members project outwardly from the goal net at said converging angle to one another.

In some instances, one of the first and second connectors is set to a greater effective length than the other of said first and second connectors, and the first and second leg pad mimicking members reside at different angles to the goal net and point in an off-center direction from said goal net.

In some instances, one of the first and second leg pad mimicking members is set to a greater effective length than the other of said first and second leg pad mimicking members, and the first and second leg pad mimicking members reside at different angles to the goal net and point in an off-center direction from said goal net.

BRIEF DESCRIPTION OF THE DRAWINGS

Preferred embodiments of the invention will now be described in conjunction with the accompanying drawings in which.

DETAILED DESCRIPTIONS OF THE DRAWINGS

Figure 1:
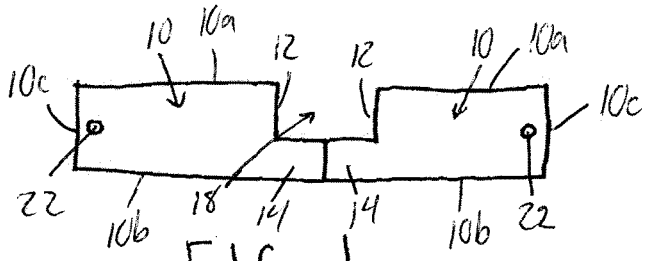
FIG. 1 is a front view of a first embodiment of a breakaway trainer according to the present invention, which features a pair of leg pad members hinged together and connectable to goal posts of a goal net in a position converging outwardly therefrom into a crease of the goal.

FIG. 1 shows a first embodiment of the breakaway trainer that features a pair of leg pad mimicking members 10 that mimic the rearwardly diverging leg pads and the front and center stick blade placement of a goalie's butterfly position, which was described above and is a commonly used goaltending technique, particularly in hockey. Each leg pad member 10 in the illustrated embodiment is a flat panel of plywood, plastic or other sufficiently hard material that can withstand the shot of a puck or other hard projectile. In the first embodiment, each leg pad member 10 is in the shape of a rectangular panel from which a smaller rectangular area has been cut out from one corner thereof. More specifically, a rectangular five-hole cutout 12 occupies an upper corner of the panel at a proximal end of the panel that is joined to the panel of the other leg pad member. A blade portion 14 of each panel remains intact below the five-hole cutout 12 to mimic half of a goal stick blade that would span across the ice between the knee areas of a goalie's two leg pads in the butterfly position.

The blade portion 14 of the two leg pad members 10 are pivotally coupled together to enable pivotal movement of the two leg pad members 10 relative to one another about a vertically upright pivot axis. This pivotal connection 16 may be provided by a hinged connection, or a flexible connection 16 that can flexibly bend back and forth, to enable hinge-like pivotal motion between the two leg pad members. A width of each leg pad member measured vertically from a horizontal top edge 10*a* thereof to an opposing and parallel horizontal bottom edge10*b* is approximately equal to the width of conventional goalie pads. Likewise, a length of each leg pad member measured horizontally from the five-hole cutout 12 to the distal end 10*c* of the leg pad member approximates the length of a conventional goalie pad. The two five-hole cutouts 12 cooperatively form a five-hole opening 18 situated between the two leg pad members 10 above the blade portions 14 thereof to simulate an elevated five-hole of a goalie whose stick is in a fully lowered and centered position on the ice. A protective cap of compressible cushion or padding can be put on the top of the leg pad members to help prevent injury in the event a user should inadvertently fall in the proximity of the leg pad members.

Figure 1A:
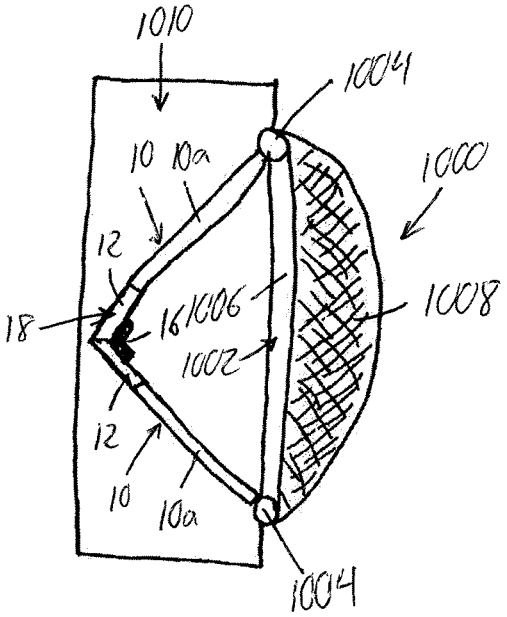
FIG. 1A is a top view of the first embodiment in use on a goal net.

FIG. 1A. shows a top view of the breakaway trainer of FIG. 1 installed on a goal net 1000. In conventional fashion, the goal net 1000 features a frame 1002 having two vertical goal posts 1004 standing vertically upward from the ice or ground surface at opposite ends of a goal line, a cross bar 1006 spanning horizontally between the goal posts 1004 at the top ends thereof, and a mesh netting 1008 attached to the frame behind the goal space bound by the posts and cross above the goal line. Near its distal end, each leg pad member features a connection hole 22 through which the leg pad member can be connected to a respective one of the goal posts 1004 during installation of the breakaway trainer on the goal net 1000. The length of each leg pad member 10 exceeds half of the goal width measured between the two goal posts 1004, whereby the connection of the two leg pad members to the two goal posts places the breakaway trainer in a condition mimicking the three-dimensional buttferfly position of a real goalie's two leg pads and stick. The pads extend forwardly outward from the goal space into the crease area 1010 in front of the goal space, i.e. the area that would be occupied by a real goalie in a game situation, and toward or into which an offensive player would typically deke or fake in order to attempt to score a goal in a breakaway situation.

FIG. 1A shows the instance in which the leg pad members are disposed symmetrically across a vertical midplane that perpendicularly bisects the goal space, in which case the two leg pad members 10 reside at the same angle relative to the mid-plane, goal space or goal line. The two leg pad members converge forwardly from the goal space, and place the hinged or flexible connection 16 near the top of the crease 1010 (i.e. the midpoint of the crease boundary line furthest from the goal space). Each leg pad member thus angles rearwardly from the hinged or flexible connection 16 at an oblique angle to the midplane, and reaches back toward the respective goal post 1004 to which that leg pad member is connected. The two leg pad members 10 thus mimic the butterfly position of a real goalie's leg pads, past which an offensive player would need to place the puck or other projectile in order to score in a breakaway situation, whether through the five-hole, over the selected leg pad behind the goalie's torso, or between the distal foot-end of the goal pad and the nearest goal post. A practicing player can place the puck or other projectile through the five-hole opening 18 between the proximal ends of the leg pad members 10, over the top edge of the leg pad members, or behind the distal ends of the leg pad members if spaced form the goal posts to which they are attached.

The three-dimensional shape of the installed breakaway trainer thus better simulates a breakaway experience compared to two-dimensional planar goalie proxies that simply lie over or in the goal space. The shaping of each leg pad member and the placement thereof in a position placing the pad length vertically upright from the ice or ground with the pad length spanning horizontally along the ice or ground likewise better resembles the area actually occupied by a real goaltender's leg pads, as opposed to the full-height panels on which a goalie image is painted in U.S. Pat. No. 3,840,228. By simulating the pads and stick blade of a goalie, but omitting a larger torso or full-body emulation of a goalie, the trainer is more compact and portable, and more stable in its installed position despite being connected only to the goal posts without any additional cross-bar connection or weighted base. The pivotally coupled flat-panel construction also enables the two leg pad members to fold up flat against one other for space efficient collapse, transport and storage. Goal nets in hockey and other sports can vary in size, and so that size of the leg pad members and overall breakaway trainer can be made in different sizes to accommodate such variation in net size.

Figure 2:
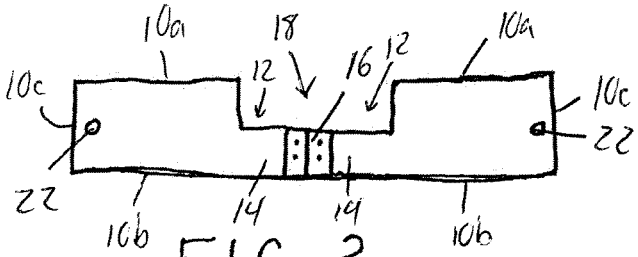
FIG. 2 is a rear view of the first embodiment.

FIG. 2 is a rear view of the first embodiment breakaway trainer showing the hinged/flexible connection 16 by which the two leg pad members 10 are pivotably coupled together to allow pivotal movement therebetween about the upright pivot axis so that the leg pad members can swing toward and away from one another to vary the angle between them, just as a goalie's padded legs may do. The height of the blade portions 14 of the leg pad members 10 spanning upward from the bottom edge 10*a* at ice/ground level up to the bottom of the five-hole cutouts 12 is preferably equal to that of a conventional goalie stick. The leg pad members 10 and their blade portions 14 thus mimic real life goal pad and stick equipment so as to provide the most life-like practice.

Figure 3:
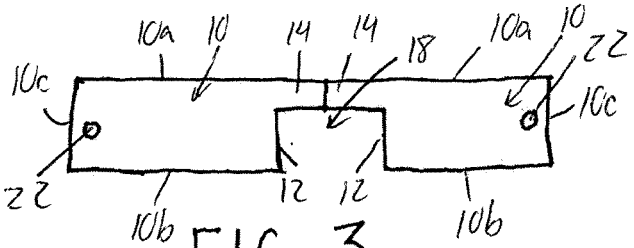
FIG. 3 is a front view of a second embodiment of the breakaway trainer.
Figure 4:
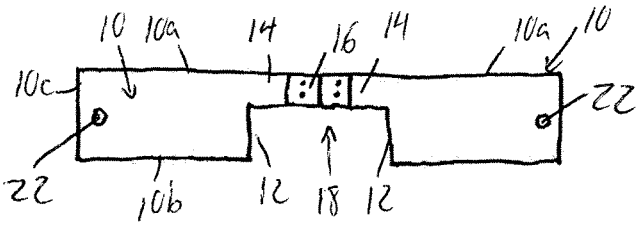
FIG. 4 is a rear view of the second embodiment.

FIG. 3 shows a second embodiment that is the same as the first, except that the five-hole cutouts 12 are not positioned at the upper corner of the proximal end, but rather at the lower corner thereof, and that the blade portions 14 thus reside above, not below, the five-hole opening 18. In this embodiment, the five hole is thus exposed at ice/ground level, as may occur during a game, for example when a goalie has lifted his/her stick blade up off the ice/ground or slide their stick off to the side. FIG. 4 shows a rear view of the second embodiment trainer, where the hinged or flexible connection hardware 16 can be seen connecting the two pads together. If the hinged or flexible connection of the first embodiment in FIG. 1 has enough pivotal range, the first embodiment breakaway trainer may be inverted for use in the same position with the ice/ground level five hole of FIG. 3, meaning that the hinged/flexible connection 16 would be visible in the front view, which would therefore resemble FIG. 4.

Figure 5:
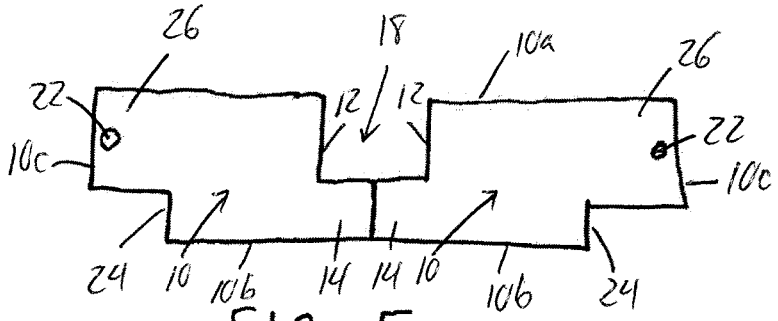
FIG. 5 is a front view of a third embodiment of the breakaway trainer.
Figure 6:
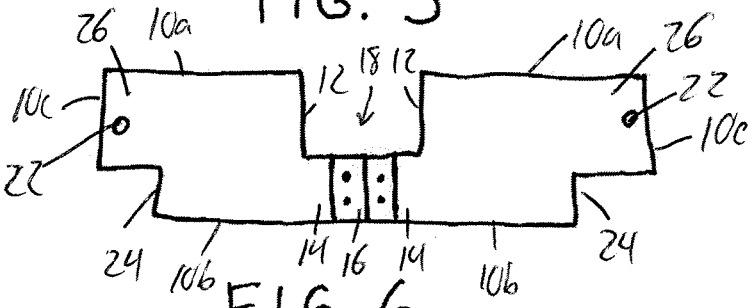
FIG. 6 is a rear view of the third embodiment.
Figure 5A:
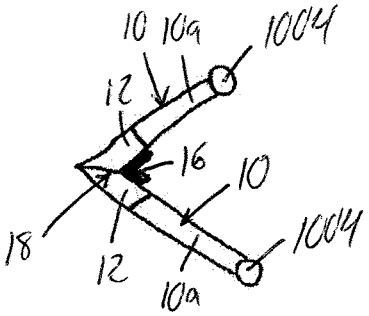
FIG. 5A is a top view of the third embodiment.
Figure 29:
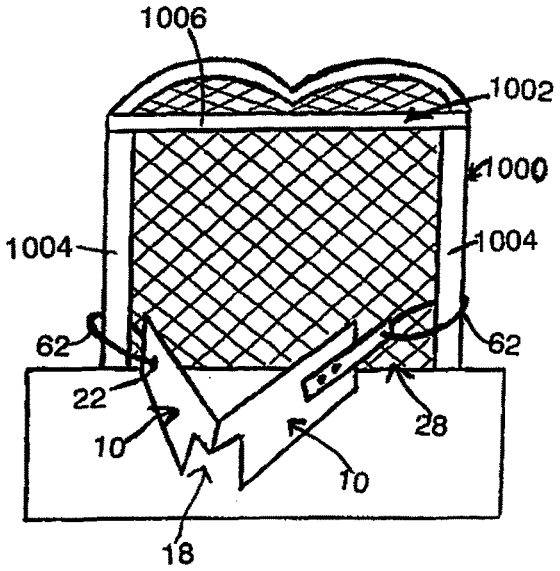
FIG. 29 is a perspective view of the second embodiment breakaway trainer of FIG. 28 adjusted to an offset position angled to one side of center, as allowed by an elongated/adjustable used in the attachment to one of the goal posts.
Figure 29A:
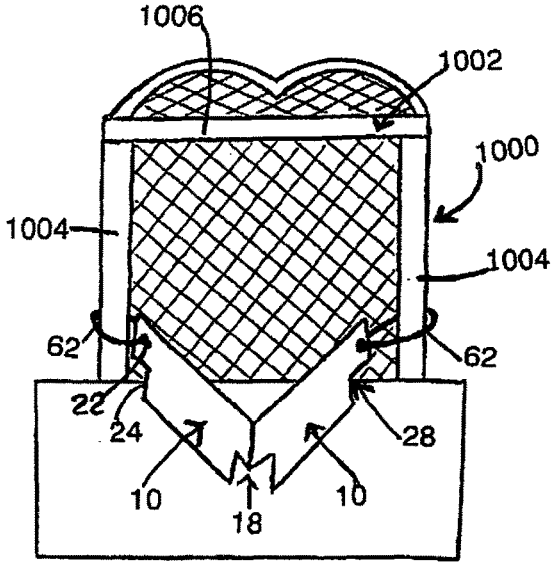
FIG. 29A is a perspective view of the third embodiment breakaway trainer of FIG. 5 once attached to the goal posts of a goal net and ready for use.

FIG. 5 shows a front view of a third embodiment of the breakaway trainer, which is the same as the first embodiment, except that instead of a single corner cutout 12 in the panel of each leg pad member 10, there are two corner cutouts 12, 24 at diagonally opposite corners of each leg pad member. So, in addition to the five-hole cutout 12, each leg pad member features an end cutout 24 that occupies the diagonally opposite corner at the bottom of the panel's distal end 10*c*. A distal connection portion 26 of each panel remains intact above the end cutout 24 and features the connector opening 22 by which the leg pad member is connectable to the respective goal post. When the breakaway trainer is installed on the goal net, this end cutout 24 leaves an open scoring hole 28 available at ice/ground level between the respective goal post 1004 and the leg pad member 10 at the distal end 10*c* thereof, as shown in FIG. 29A. This emulates another area at which the user may score on a goaltender on a breakaway, as the goalie's skates or the foot ends of the goalie's leg pads will not perfectly align with goalpost 1004, and thus create another weak point for the offensive player to exploit. The breakaway trainer thus accurately mimics goalie pad conditions experienced in a real game situation. FIG. 5A Is a top view of the third embodiment showing how it once again projects outward into the playing area to provide a three-dimensional goalie emulation, as opposed to a planar two-dimensional structure running along the goal line. FIG. 6 shows a rear view of the same breakaway trainer as FIG. 5, thus showing the hinged/flexible connection 16.

Figure 7:
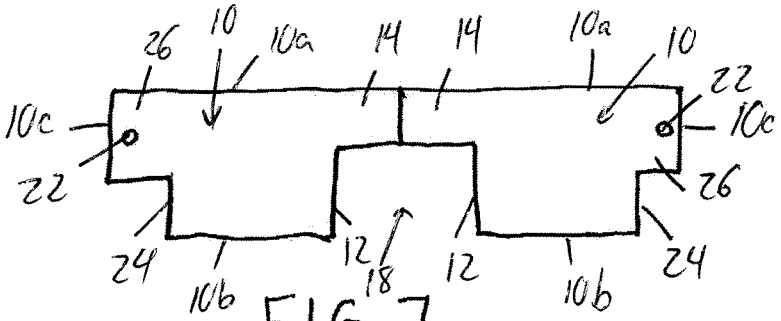
FIG. 7 is a front view of a fourth embodiment of the breakaway trainer.
Figure 8:
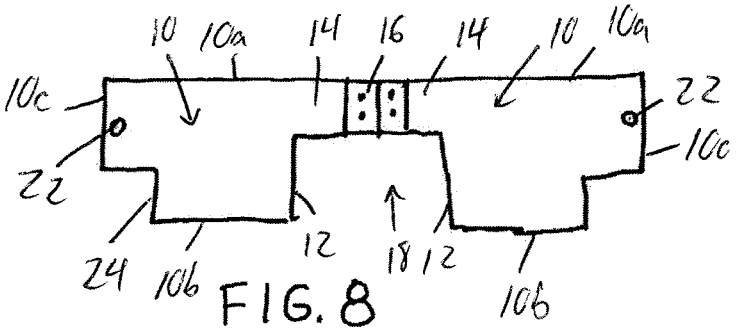
FIG. 8 is a rear view of fourth embodiment.
Figure 7A:
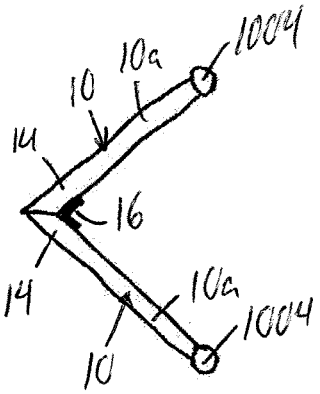
FIG. 7A is a top view of the fourth embodiment.

FIG. 7 is a front view of a fourth embodiment of the breakaway trainer that features the same distal lower corner end cutouts 24 of the third embodiment, but has the five-hole cutouts 12 at the lower corners the leg pad members' proximal ends, like in the second embodiment of FIGS. 3 and 4. This provides an ice/ground level five-hole opening like the second embodiment that is not obstructed by the blade portions 14 by which the two pads are connected. This simulates a game scenario where the goalie's stick is lifted off the ice/ground and exposes an ice/ground level five-hole opening, or where the goalie pushes off to the side in either direction, for example in response to a deke or fake, thus drawing the knees apart and exposing the ice/ground level five-hole as shown. FIG. 8 is a rear view of the fourth embodiment, showing the exposed five-hole opening 18, the hinged/flexible connection 16, and the connector holes 22 for connecting to the goal posts. FIG. 7A is a top view of the fourth embodiment, showing how it protrudes outward for a life-like three-dimensional goalie emulation or appearance when connected to the goal posts 1004.

Figure 9:
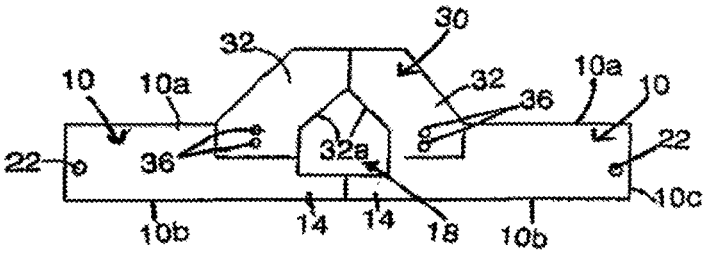
FIG. 9 is a front view of a fifth embodiment of the breakaway trainer.
Figure 9A:
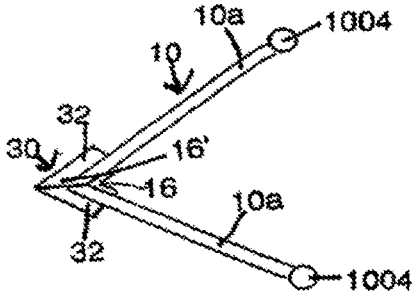
FIG. 9A is a top view of the fifth embodiment.
Figure 10:
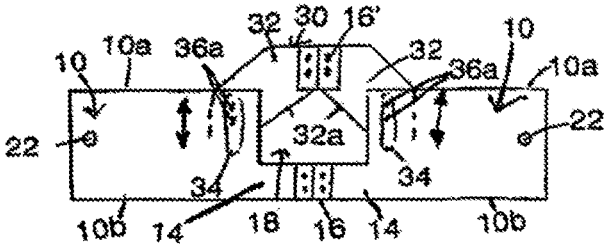
FIG. 10 is a rear view of the fifth embodiment.

FIG. 9 is a front view of a fifth embodiment in which the leg pad members have the same panel shapes as the first embodiment, but featue the addition of an adjustable five-hole attachment 30. The five-hole attachment 30 is movably mounted to the frontside of the leg pad members 10 and is adjustable upwardly and downwardly thereon to allow the user to vary the size of the five-hole opening 18 to allow tailored practice according to their current level of skill. In the illustrated embodiment, the five-hole attachment 30 has a two-piece construction in which two flat-panel pieces 32 of matching shape each have a lower end fastened to a respective one of the leg pad members 10 near the top edge 10*a* thereof and adjacent to the five-hole cutout 12 therein. The two five-hole attachment pieces 32 angle obliquely upward from their respective leg pad members in a converging manner, and are joined with one another by a second hinged/flexible connection 16' situated above the hinged/flexible connection 16 at the apex of the converging leg pad members 10.

The two five-hole attachment pieces 32 thus converge at the same angle as the leg pad members 10, and can pivot relative to one another about the vertical pivot axis of their hinged/flexible connection 16' to adjust this angle. The connected together five-hole pieces 32 collectively span over the five-hole opening 18 between the two leg pad members 10, thus defining an upper boundary limit of the five-hole opening 18. By selective locking or fastening of the five-hole attachment 30 at a selected height on the leg pad members 10, the height of the five-hole opening 18 can thus be adjusted to change the side thereof. In the illustrated embodiment, facing-together inner edges 32*a* of the two five-hole pieces 32 are obliquely inclined to slope upwardly toward one another, imparting a peaked triangular shape to at least an upper area of the five-hole opening 18. Depending on the selected height, the five-hole opening 18 may have a triangular or pentagonal shape, depending on whether these sloped edges 32*a* are lowered down to intersect the plane of the bottom boundary of the five-hole opening 18 at the upper edge of the blade portions 14 of the leg pad members.

The hardware attachment system by which the five-hole attachment 30 is adjustably mounted to the pad pieces can have various designs made from various products. In the illustrated example, a respective upright slot 34 is provided in each leg pad member 10 beside the respective five-hole cutout 12, though which one or more threaded shafts 36*a* of suitable fastening hardware 36 are received. These threaded shafts of the fastening hardware protrude from the backside of the respective five-hole attachment piece 32. The shafts 36*a* are slidable up and down in the slots 34 to adjust the height of the five-hole attachment 30, and tightening of mating nuts on the threaded shafts of the fastening hardware 36 will tighten the five-hole attachment 30 to the leg pad members 10 at the selected height to set the desired size of the five-hole opening 18. Alternatively, the slots 34 may be defined on the five-hole attachment 30 for receiving threaded shafts 36*a* protruding from the leg pad members 10, preferably at the backside thereof so as not to project from the frontside of the leg pad members, where they would be exposed to impact by oncoming shots on net. It will be appreciated that the terms front and forward are used herein to refer to the direction facing away from the goal net, and rear, rearward, back and backward refer to the direction facing the goal net. Instead of elongated slot-shaped holes 34 in which fastener shafts 36*a* are slidable, multiple sets of discrete fastening holes at different heights may be provided, though the slotted connections of the illustrated embodiment provide for finer tuned adjustment of the five-hole 18.

Figure 11:
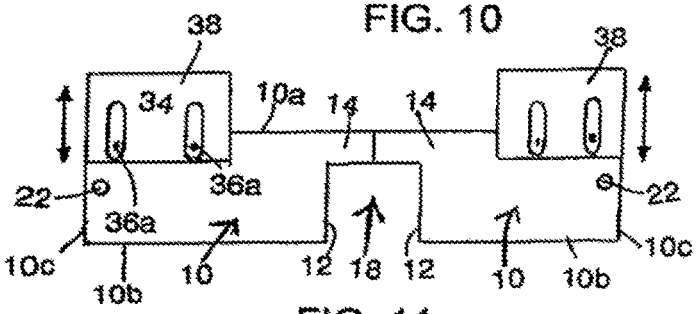
FIG. 11 is a front view of a sixth embodiment of the breakaway trainer.

FIG. 11 is a front view of a sixth embodiment in which the leg pad members can have other add-on pieces 36 added onto them to mimic a goalie pad stack, where a goalie places a second piece of padding over one or both of his leg pads to increase the effective shot-blocking height thereof. For example, the stacked second pad may be the other leg pad (where the goalie lays onto his/her side with one leg over the other), or may be his/her hand-worn goalie glove or goalie blocker. This will allow the user to practice pad-stacked goalie situations. The pad stack is adjustable in height so to vary the amount of goal space blocked and thereby adjust to different skill levels. These pad add-ons can be made to look like a glove or blocker to make it even more realistic to the user. In the illustrated embodiment, two such pad stack attachments 38 are included, one for each leg pad member 10, and each being smaller than the respective leg pad member 10. This way, one of these pad stack attachments 38 emulates the glove worn on one of the goalie's hands, while the other emulates the blocker worn on the other goalie hand. In the illustrated example of FIG. 11 however, the add-on pad stacking attachments 38 are generic rectangular attachments, neither of which has been cut to more closely resemble an actual goalie glove.

The pad stacking attachments 38 are each mounted to a respective one of the pad members 10 at or near the distal end thereof, for example using the same type of slotted connection 34, 36 as the five-hole attachment pieces 32 of the preceding embodiment. Each pad stacking attachment 38 is thus adjustable in height to vary far upwardly beyond the top edge 10*a* of the respective leg pad member 10*a* it will reach. While the illustrated example has the elongated slots 34 in the pad stacking attachments 38 at the backside of the pad members 10, and feeds the fastening hardware 36 through the slots 34 from the leg pad members 10, the opposite slot/fastener configuration like that of the five-hole attachment 30 may alternatively be employed.

The illustrated pad stacking attachments are sized to approximate a goalie glove and goalie blocker, and thus each span only a only a partial lengthwise fraction of the respective leg pad member 10. Another pad stacking attachment intended to simulate stacking of two leg pads may use a longer attachment, for example spanning the full length of the leg pad member 10. The term pad stacking attachment is thus used herein to encompass any such attachment, regardless of whether it is approximately leg pad sized, glove sized or blocker sized.

Figure 12A:
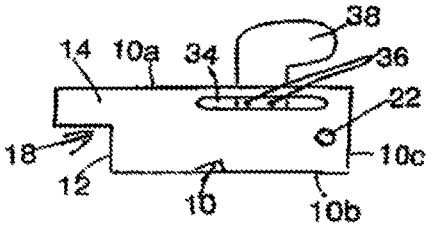
FIGS. 12A and 12B are opposing side elevational views of the two leg pad members and respective attachments in a variant of the sixth embodiment.
Figure 12:
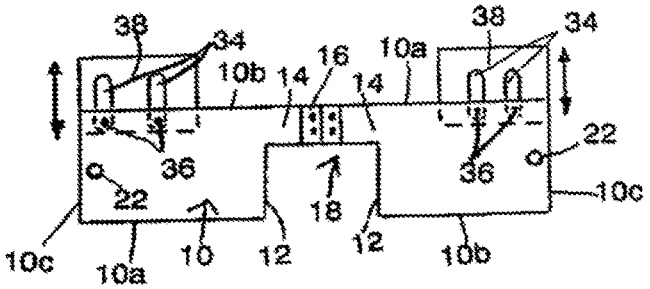
FIG. 12 is a rear view of the sixth embodiment.
Figure 11A:
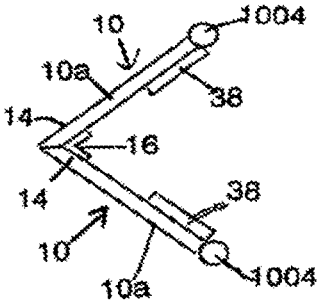
FIG. 11A is a top view of the sixth embodiment.
Figure 12B:
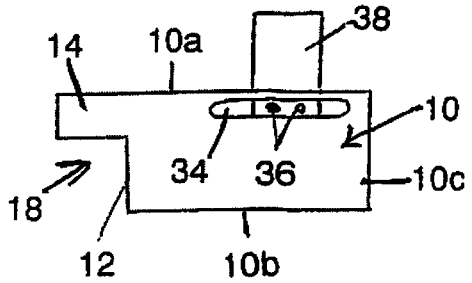

As an alternative to being height-adjustable, each pad stacking attachment 38 may be laterally adjustable to shift its position selectively back and forth along the length of each pad member 10, as shown in the variant of FIGS. 12A and 12B, for example to emulated different glove and blocker positions in which a real goalie may place his hands. In this variant, the slotted connection has horizontally elongated slots running in the horizontal length direction of the leg pad members 10, rather than vertically elongated slots of FIG. 11, which run in the vertical width direction of the leg pad members 10. The variant shown in FIGS. 12A and 12B also demonstrates how the pad stacking attachments may vary in size and shape from one another so that one more closely resembles a goalie glove (FIG. 12A), and the other more closely resembles a goalie blocker (FIG. 12B).

Figure 13:
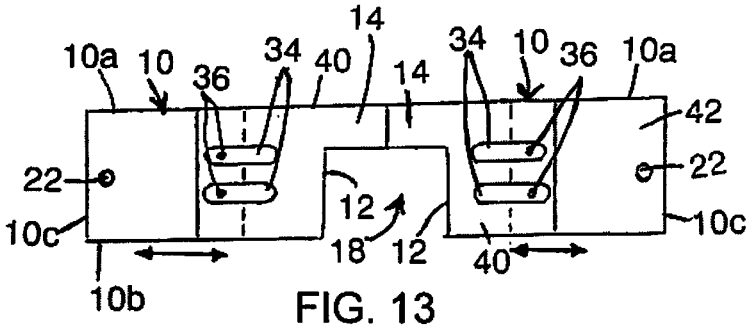
FIG. 13 is a front view of a seventh embodiment of the breakaway trainer.
Figure 14:
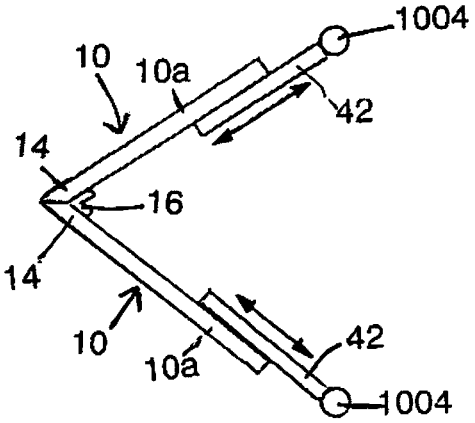
FIG. 14 is a top view of the seventh embodiment.

FIG. 13 is a front view of a seventh embodiment wherein each pad 10 is of two-piece construction having a main panel 40 and an extension panel 42 movably mounted thereto to enable extension and collapse of the leg pad member 10 in the length direction. The main panels 40 of the two leg pad members 10 define the blade portions 14 at which the two leg pad members 10 are pivotably joined by the hinged/flexible connection 16, while the extension panels 42 reach rearwardly from the main panels 40 to define the distal ends 10*c* of the leg pad members 10. As illustrated, the two panels 40, 42 of each leg pad member may be adjustably connected by the same slotted connection 34 and fastener hardware 36 used to adjustably connect the leg pad members 10 and pad stacking attachments 38 in the preceding embodiment, but with the elongated slots 34 running horizontally lengthwise of the leg pad members 10 to enable adjustment of the distance by which the extension panels 42 projects rearwardly from the main panels 40. Though the illustrated embodiment has the slots 34 machined in the main panels 40 and the threaded fastener shafts protruding from the extension panels, this configuration may be reversed. Likewise, while the illustrated embodiment places the extension panels 42 behind the main panels 40, this configuration may be reversed. FIG. 14 is a top view of the seventh embodiment showing how the leg pad members 10 can be extended to allow for the pads to reach further outwardly into the playing area from the goal posts 1004 to which they are connected. This allows further variation in the relative angle between the leg pad members and variation in the size and three-dimensional shape of the goalie emulation created thereby.

Figure 15:
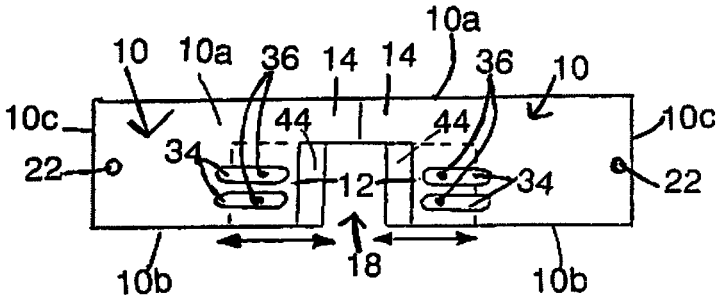
FIG. 15 is a front view of an eighth embodiment of the breakaway trainer.
Figure 16:
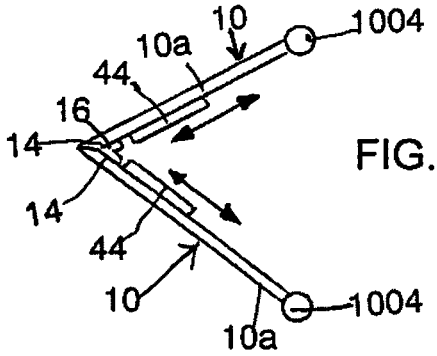
FIG. 16 is a top view of the eighth embodiment.

FIG. 15 is a front view of an eighth embodiment in which the five-hole 18 is adjustable in a left-to-right horizontal direction to adjust the width or location of the five-hole. To enable this, a respective five-hole flap 44 is movably mounted to each leg pad member 10 for selective adjustment of a horizontal distance by which the flap 44 projects into the five-hole opening 18 between the two leg pad members. The five-hole flaps 44 may use the same slotted connection type 34, 36 as the extension panels 42 in the preceding embodiment, but with the slots 34 positioned proximate the five-hole cutouts 12 of the leg pad members 10 rather than the distal ends of the leg pad members 10. The five-hole flaps 44 can be slid back and forth in the length direction of the leg pad members to change distance by which they project into the five-hole opening 18 to change the effective width thereof. Selective tightening of the fastener hardware 36 will tighten the five-hole flaps 44 against the leg pad members to lock them in place and maintain the selected size and position of the effective five-hole area bound between the proximal ends of the two five-hole flaps 44. FIG. 16 is a top view of the eight embodiment when connected to the goal posts 1004. The illustrated arrows show how the five-hole flaps can be moved into and held in a desired position.

Figure 17:
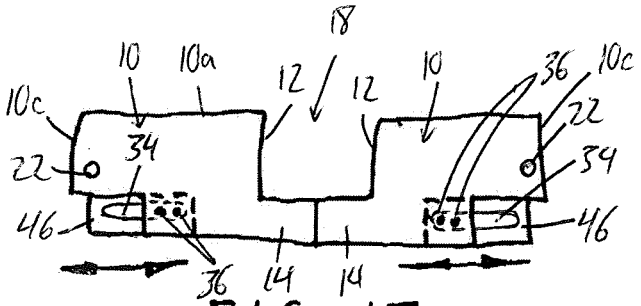
FIG. 17 is a front view of a ninth embodiment of the breakaway trainer.
Figure 18:
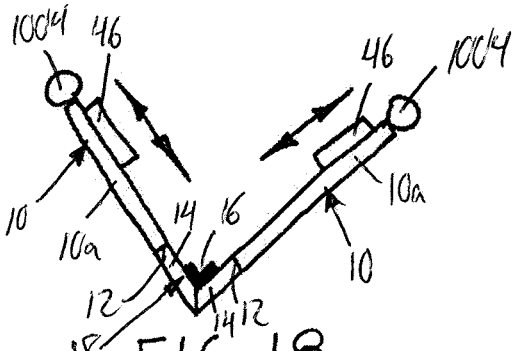
FIG. 18 is a top view of the ninth embodiment.

FIG. 17 is a front view of a ninth embodiment in which the open scoring hole 28 at the distal end of each leg pad member 10 is adjustable in a horizontal left-to-right width direction to adjust an effective width of this scoring hole 28 between the leg pad member 10 and the respective goal post 1004. To enable this, a respective adjustment flap 46 is movably mounted to each leg pad member 10 for selective adjustment of a horizontal distance by which the adjustment flap 44 projects into the end cutout 24 at the distal lower corner of the leg pad member 10. The adjustment flaps 46 may use the same slotted connection type 34, 36 as the five-hole flaps 44 in the preceding embodiment, but with the slots 34 positioned proximate the end cutouts 24 of the pads 10 rather than the five-hole cutouts 12. The adjustment flaps 46 can be slid back and forth in the length direction of the leg pad members 10 to change distance by which they project into the scoring hole 28 to change the effective width thereof. Selective tightening of the fastener hardware 36 will tighten the adjustment flap 46 against the leg pad members to lock them in place and maintain the selected size of the effective scoring areas bound between the goal posts 1004 and the distal ends of the adjustment flaps 46. FIG. 18 is a top view of the ninth embodiment when connected to the goal posts. The illustrated arrows show how the adjustment flaps 46 can be moved into and held in a desired position.

Figure 19:
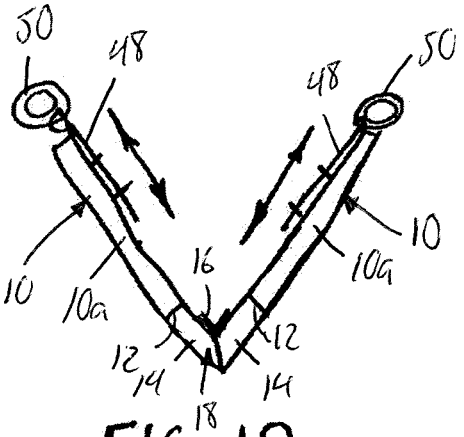
FIG. 19 is a top view of a tenth embodiment of the breakaway trainer.

FIG. 19 is a top view of a tenth embodiment in which the effective lengths of the leg pad members are adjustable, similar to the seventh embodiment. However, instead of extension panels 42 adjustably mounted to the main panels 40 that define the proximal ends and blade portions of the pads, the tenth embodiment features a pair of extension rods 48 each slidably supported on a respective one of the leg pad members 10 for sliding movement back and forth thereon in the horizontal lengthwise direction of the leg pad member. Each extension rod 48 features a closed ring 50 at its end that replaces the connection hole 22 in the leg pad members of the earlier embodiments for the purpose of connecting the extendable/collapsible leg pad member 10 to the respective goal post 1004 by various methods. The ring-equipped end of each extension rod 48 forms the effective distal end of the extendable/adjustable leg pad member 10 in this embodiment, whereby the selective sliding of the extension rod 48 back and forth varies the overall effective length of the extendable/collapsible leg pad member 10. The rods 48 may be supported by a plurality of tightenable/loosenable clips 52, e.g. U-bolt wire rope clips, that allow sliding of the rod 15 when loosened, but hold the rod 48 firm on the pad at a selected position when tightened in order to maintain selected effective length of the leg pad member. The extension rods 48 and clips 52 are mounted to the backsides of the leg pad members 10 so as not to interfere with deflection of a puck or other projectile impacting the frontside of the leg pad members 10.

Like in the seventh embodiment, adjustment of the effective lengths of the leg pad members by the movable extension rods 48 allow the user to change the distance and angle by which each leg pad member 10 reaches forwardly from the respective goal post 1004, thereby enabling movement of the leg pad members left or right and forward and backward relative to the goal net 1000. This allows for various simulated goalie pad situations to be accomplished and adjusted very quickly and easily. Lengthening both leg pad members 10 pushes the apex of their joined-together V-shape further forward from the goal net 1000, and reduces the relative angle between the two leg pad members, thus narrowing the collective V-shape of the converging leg pad members. Shortening both leg pad members has the reverse effect, drawing the apex of their joined-together V-shape rearward toward the goal net, thus increasing the relative angle between the two leg pad member and widening the V-shape. Shortening one leg pad member to a lesser effective length than the other draws the apex rearwardly toward the goal net, and laterally outward from the mid-plane of the goal toward the respective goal post to which the shorter pad is connected. Likewise, lengthening of one leg pad member to a greater effective length than the other draws the apex rearwardly toward the goal net, and laterally outward from the mid-plane of the goal toward the respective goal post to which the shorter leg pad member is connected. Such differentiation in the effective lengths of the two leg pad members in order to point the vertex outward from the mid-plane in an off-center direction form the goal net is shown in FIG. 29, where the left leg pad member has been set to a shorter effective length than the right leg pad member, and so the longer right leg pad member resides at a lesser angle to the goal line than the shorter left leg pad member.

Figure 20:
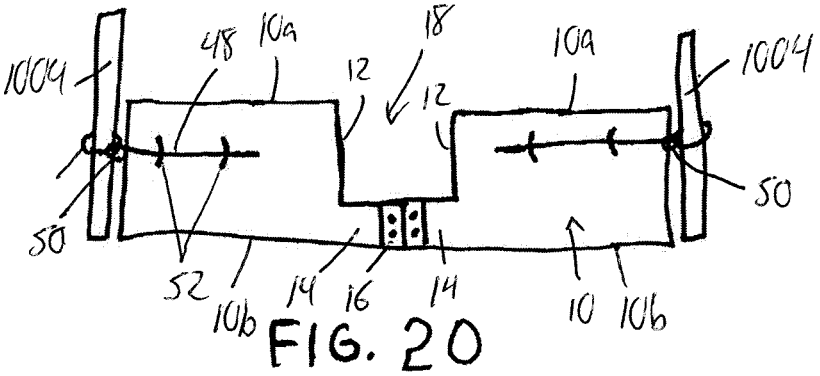
FIG. 20 is a rear view of the tenth embodiment.

FIG. 20 is a rear view of the tenth embodiment, showing the clips 52 that connect to the backside of the leg pad members 10 and hold the extension rods 48 thereon, and that allow the extension rods 48 to move freely back and forth when loosened. The closed rings 50 at the distal ends of the rods 48 are connectable to the goal posts 1004 using various connectors, examples of which are described further below. Once again, hinge-type hardware or a flexible connector 16 holds the leg pad members 10 together, while allowing pivotal movement therebetween when disconnected or loosened from the goal posts 1004 to set different pad angles and positions.

Figure 21:
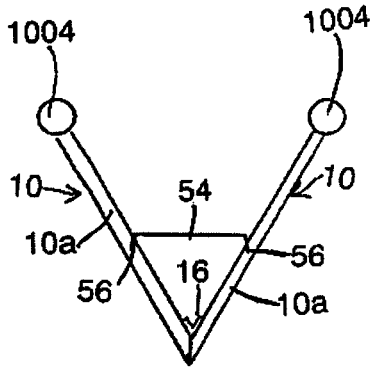
FIG. 21 is a top view of an eleventh embodiment of the breakaway trainer.
Figure 21A:
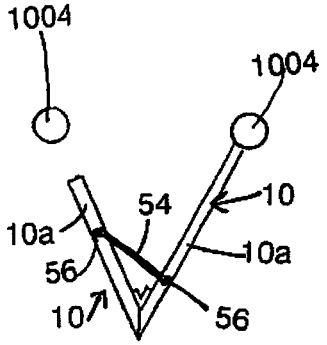
FIG. 21A is a top view of the eleventh embodiment, illustrating an adjustability of the angle between the goal pads.

FIG. 21 is a top view of an eleventh embodiment in which the leg pad members 10 can be set and maintained at different relative angles to one another by a pad spreader 54. In the illustrated example, the pad spreader is a relatively rigid bar having a central span 54*a* and two downturned ends 54*b*. Each leg pad member 10 has a plurality of predrilled holes 56 arranged in series in the lengthwise direction of the leg pad member in the top edge 10*a* thereof. Each hole 56 is sized to enable selective receipt of one of the spreader's downturned ends 54*b* therein. When the two downturned ends 54*b* of the spreader are inserted into a pair of selected holes in the two leg pad members, these downturned ends 54*b* of the bar cooperate with the central span 54*a* of the bar to prevent relative pivoting between the two leg pad members about the hinged/flexible connection 16, thus locking the two pads at a fixed angle to one another. Changing the selected pair of holes into which the spreader 54 is inserted changes this relative angle between the leg pad members 10 the trainer. FIG. 21A is another top view illustrating insertion of the pad spreader 54 into a different pair of holes to set a different angle between the leg pad members, and also demonstrating shortening of one leg pad member (the illustrated left pad member) relative to the other to leave a larger scoring hole between the distal end of this shortened leg pad member and the respective goal post than between the distal end of the longer leg pad member and its respective goal post. The use of length adjustable leg pad members can thereby be used to set operating characteristics other than the relative leg pad angles.

Figure 21B:
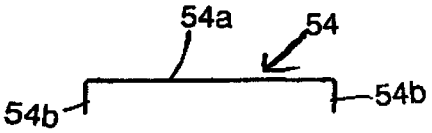
FIG. 21B is a front view of a spreader of the eleventh embodiment that is used to fix the goal pads at a selected angle.
Figure 21C:
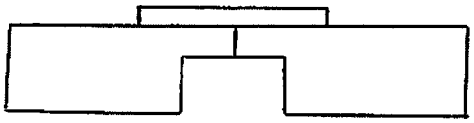
FIG. 21C is a front view of the eleventh embodiment.

FIG. 21B is an isolated front view of the goal pad spreader. It can be made from metal, or any one of several different types of materials that can withstand the force of a hockey puck. The pad spreader 54 may be bendable to adjust the straight-line distance between its downturned ends, thereby providing another means by which the angle between two pads may be varied to a desired user angle. In such instances of a bendable pad spreader, as few as one pair of holes in the leg pad members is sufficient to allow at least some degree of adjustability, though as described and illustrated, multiple pairs of holes may be provide for optimal adjustability. FIG. 21C is a front view showing the pad spreader installed on top of the leg pad members in order to set them at the user-selected angle.

Figure 22:
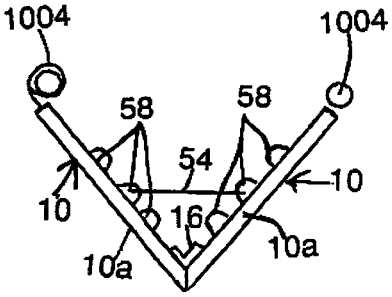
FIG. 22 is a top view of a twelfth embodiment of the breakaway trainer.
Figure 22A:
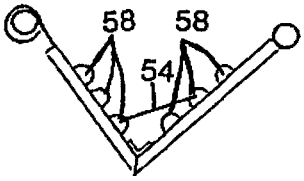
FIG. 22A is a top view of the twelfth embodiment illustrating the adjustability of the angle between the goal pads.
Figure 22B:
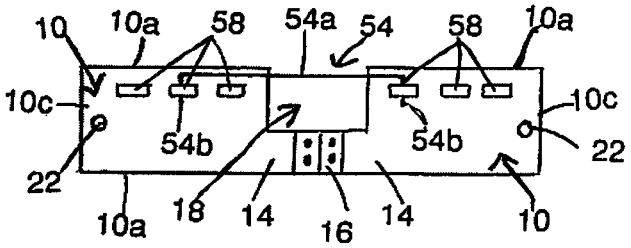
FIG. 22B is a rear view of the twelfth embodiment.

FIG. 22 is a top view of a twelfth embodiment featuring the same pad spreader 54 of the eleventh embodiment, but using a clip or loop system attached to the backside of the leg pad members 10 to receive the downturned ends 54*b* of the spreader rather than holes in the topside of the leg pad members. The clips or loops 58 are attached at several intervals along the length direction of each pad, thereby allowing he pads to be placed at several different angles that might occur between a goalie's pads in a breakaway situation. This clip or loop system is placed on the inside of the pad system (i.e. the backsides of the leg pad members that face inwardly toward one another and rearwardly toward the goal net) so as not to get hit by the projectile and suffer potential damage or breakage. FIG. 22A is a top view of the pad spreader system demonstrating the various angles that can be created using cooperation between the spreader with the ring clips or loops 58. It allows the user to place the pad spreader 54 into the various ring clips to create adjustability in pad angles and thereby simulate a real game situation. FIG. 22B is a rear view of the pad spreader system, showing the different ring clips or loops 52 connected to the backside of the leg pad members 10 so they don't get struck by the projectile, and once again showing the hinged/flexible connection 16 between the leg pad members 10 to accommodate the varying pad angles.

Figure 23:
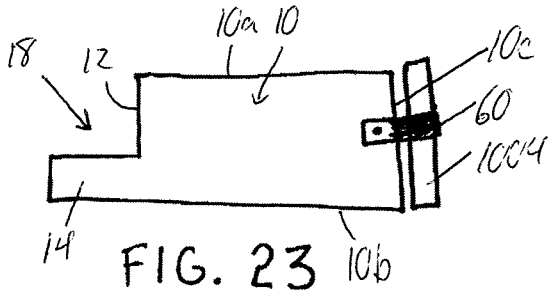
FIG. 23 is a right-side view illustrating a first connection type usable in any of the first to ninth, eleventh and twelfth embodiments to connect the leg pad members to the goal posts.
Figure 23A:
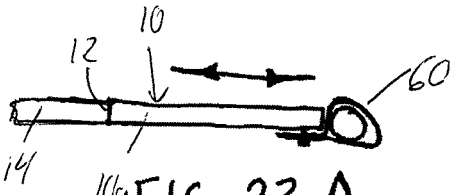
FIG. 23A is a top view of the first connection type of FIG. 23.

FIG. 23 is a side view demonstrating a first type of connection that can be employed between each leg pad member 10 and the respective goal post 1004. In this example, an adjustable strap 60 is wrapped around the goal post 1004 and has one end fastened to the pad 10 via the connection hole 22 near the distal end 10*c* thereof. This keeps the pad system connected to the post so that once struck by the projectile it won't move around. The strap 60 can be adjusted in length to allow the leg pad member 10 to be moved further from the post and project further into the playing area, thereby opening up a larger scoring area between the distal end of the leg pad member 10 and the respective goal post 1004. FIG. 23A is a top view of the adjustable strap connector 60. The strap 60 is fastened through the connection hole 22 and wrapped around the goal post 1004, and then optionally tightened to pull the distal end of the leg pad member 10 tight against the goal post to form a solid connection. This allows the pad system to be struck by a projectile and not move around. Alternatively, loosening of the strap 60 to a larger size of closed loop around the goal post 1004 allows the user to extend the leg pad member 10 forwardly off the goal post 1004 and more into the playing area. This gives the user great flexibility when using the pad system to simulate various goalie positions of varying distance from the goal line.

Figure 24:
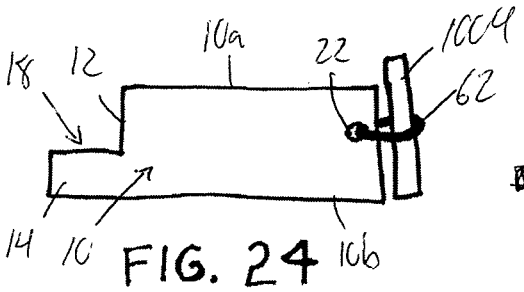
FIG. 24 is a right-side view illustrating a second connection type usable in any of the first to ninth, eleventh and twelfth embodiments to connect the leg pad members to the goal posts.
Figure 24A:
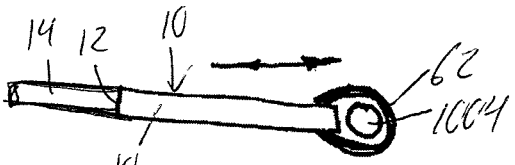
FIG. 24A is a top view of the second connection type of FIG. 24.

FIG. 24 is a side view demonstrating a second type of connection that can be employed between each leg pad member 10 and the respective goal post 1004. This connection type employs a Velcro™ strap, tie-able rope or some other flexible connection 62 of adjustable size that is threaded through connection opening 22 and allows for adjustment of the leg pad member 10 relative to the goal post 1004. The connector 62 is threaded through the connector hole 22 and wrapped around the gaol post 1004 into a closed loop of adjustable size. The connector 62 can be shortened or lengthened to increase or decrease the loop size depending on the user's desire, which allows the leg pad member 10 to be held close to the goal line or to extend more into the playing area. This gives the user the ability to reproduce game pad situations quickly and easily. FIG. 24A is a top view of the Velcro strap, rope or other flexible connector 62. The arrow shows the direction the connector will allow the pads to move during adjustment to enable tight connection to the post or loosened connection extended further away from the goal space into the game area.

Figure 25:
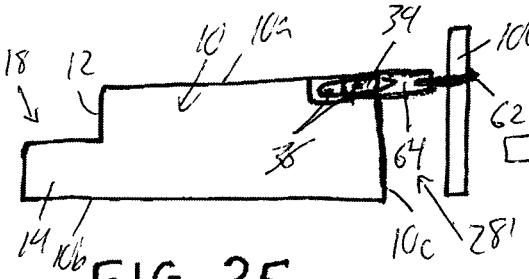
FIG. 25 is a right-side view illustrating a third connection type substitutable for the first or second types of FIGS. 23 and 24.

FIG. 25 is a side view of a third type of connection that can be employed between each leg pad member 10 and the respective goal post 1004. This connection type employs an extension 64 like those of the seventh and tenth embodiments. However, instead of a full-width extension panel 42 spanning the full height of the leg pad member 10 like in the seventh embodiment, or a cylindrical rod-type extension 48 like the tenth embodiment, the extension 64 is a flat strip of notably lesser vertical width than the pad member. The extension strip 64 is adjustably mounted to the leg pad member 10 in an elevated position near the upper edge 10*a* thereof, thus placing the extension strip 64 in an elevated position well above the ground or ice surface on which the bottom edge 10*b* of the leg pad member 10 resides. The main panel of the leg pad member 10 has a vertically linear edge at its distal end, from which the extension strip 64 can extend by a variable distance to set the overall effective length defined by the combination of the main panel and the extension strip. This leaves a scoring opening 28' open below the extension strip 64 between the goal post 1004 and the distal end 10*c* of the pad member 10, just like the scoring opening 28 of the pads with the lower end cutouts 24. The extension strips 64 may be adjustably mounted to the leg pad members 10 by the same slotted connection as the adjustment flaps 46 of the ninth embodiment, whereby the extension strips 64 can be slid back and forth in the length direction of the pads 10 to change distance by which they project from the distal end of the pads 10.

Figure 25A:
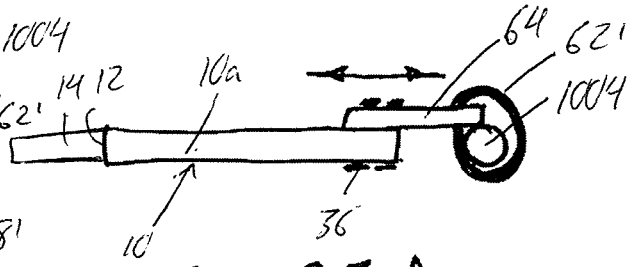
FIG. 25A is a top view of the third connection type of FIG. 25.

The extension strips 64 can be made from anything that can withstand a hockey puck or other hard projectile. A distal end of each extension strip 64 furthest from the pad member 10 features a connection hole 22' through which a connection strap 62' (whether adjustable or not), rope or the like can be wrapped around the goal post to secure the extension strip 64 and the attached leg pad member 10 to the goalpost. Reducing the distance by which the extension strip projects form the distal end of the pad member draws the leg pad member 10 closer to the goal post 1004, while increasing this distance pushes the leg pad member 10 further outward into the playing area. Once again, the slotted connection has suitable fastening hardware 36 that can be tightened through the cooperating slot 34 to hold the extension strip 64 at a selected position and thereby maintain the selected pad distance from the goal post. FIG. 25A is a top view of the slotted extension strip connection of FIG. 25, showing how the fastening hardware 36 runs through the leg pad member 10 and slotted strip 64 to allow for adjustability. The slotted strip allows the user to pull the leg pad members 10 further from the goal post 1004 while they remain connected thereto by connector 62'. The user can change the relative angle of the leg pad members easily and quickly.

Figure 26:
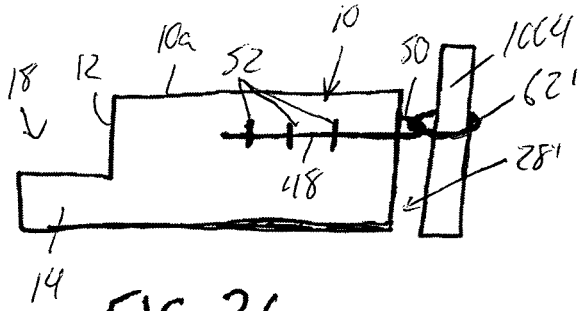
FIG. 26 is a right-side view illustrating a fourth connection type used in the tenth embodiment.

FIG. 26 is a side view of a fourth type of connection that can be employed between each leg pad member 10 and the respective goal post 1004, and more particularly the type of connection described above in relation to FIG. 19. The U-bolt clips 52 allow the rods 48 to slide easily through them when loosened to make for quick pad length adjustments. The U-bolt clips 52 are connected on the inside of the leg pad members so they don't break when impacted by the hard projectile. The leg pad members can be moved outward, inward and left to right easily and quickly. This allows the user to change pad angles to practice various breakaway angles with ease. The rods 48 each have a closed ring 50 on the end to allow for any type of connector 62' such as a Velcro strap, rope or other means of connection to the respective goal post.

Figure 26A:
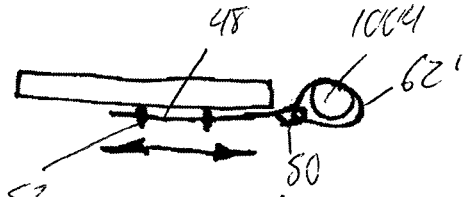
FIG. 26A is a top view of the fourth connection type of FIG. 26.
Figure 26B:
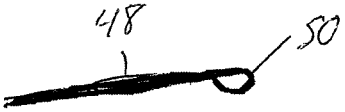
FIG. 26B is an isolated view of an adjustable extension rod of the fourth connection type of FIG. 26.

FIG. 26A is a top view of the adjustable extension rod 48, illustrating how it enables movement back and forth relative to the goal post 1004. It is connectable to the goal post by various connectors 62' such as rope, Velcro or other means. The clips 52 are connected to the leg pad members 10 at various intervals so the rod 48 moves freely. The rod end has a ring 50 so that the connectors 62' don't fall out and allow it to come free from the goal post. FIG. 26B is a top view of the extension rod 48 with a closed ring 50 at one end. This closed ring 50 allows for all suitable types of connectors 62' to hold the rod system to the post and not fall out. This rod 48 can be made from metal or any other type of material capable of withstanding impact by a hockey puck or other hard projectile. The extension rod 48 has a diameter of notably lesser measure than the vertical width of the pad member 10, and like the extension strip 64, the rod is situated in elevated relation from the ground/ice surface and the overlying bottom edge 10*b* of the pad. Accordingly, the extension rod 48 leaves a scoring opening 28' available between the goal post 1004 and the distal end 10*c* of the leg pad member 10 at the space below the rod 48.

Figure 27:
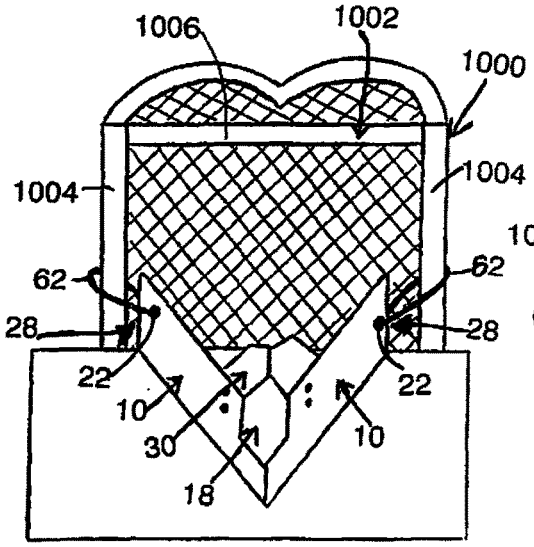
FIG. 27 is a perspective view of the fifth embodiment breakaway trainer of FIG. 9 once attached to the goal posts of a goal net and ready for use.

FIG. 27 is a perspective view of the breakaway trainer of FIG. 9 when connected to the goal net. It shows how the trainer extends into the crease and resembles a three-dimensional butterfly goal pad stance, as typically faced when a player is on a breakaway. The five-hole opening 18 is centered in the crease at the mid-plane of the goal space and can be sized according to the current talent level of the user. The goal stick simulating blade portions 14 create a closed-bottom five hole opening 18 to show the offensive player a realistic goalie stance where the goalie's stick blade is at ice level below the five-hole. This view shows all the available breakaway scoring zones, particularly the 5-hole opening, elevated left or right areas over the leg pad members 10, and the distal end scoring openings 28 between the post and the leg pad members. The user can make a deke at the top of the crease and then practice one of the previously mentioned moves.

Figure 28:
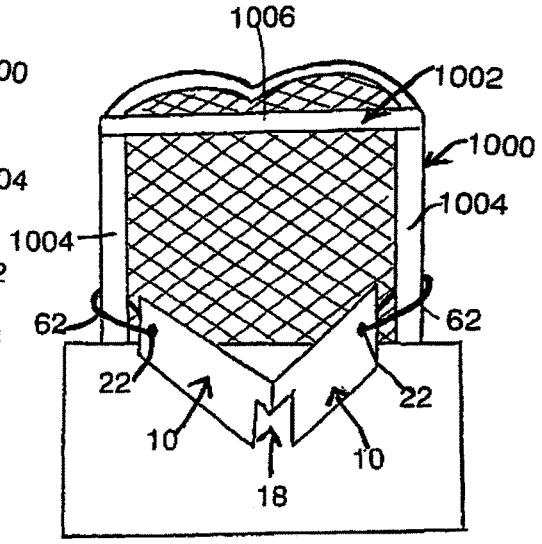
FIG. 28 is a perspective view of the second embodiment breakaway trainer of FIG. 3 once attached to the goal posts of a goal net and ready for use.

FIG. 28 is a perspective view of the breakaway trainer of FIG. 3 when connected to the goal net. The five-hole 18 reaches right down to the bottom of the leg pad members 10 and is therefore totally open at ice level. This can be achieved by removal of the five-hole upper attachment 30 from the FIG. 27 configuration, and inversion of the leg pad members 10 to provide this open-bottom five-hole scenario This stance is found when the goalie pushes off to move to either the left or right which then leaves the bottom of the five-hole wide open for a short period of time. The user can be on a breakaway against the trainer, then make a deke and slide the projectile through the open-bottomed five-hole. As shown, through slack in loosened connectors 62 or adjustment of the relative lengths of the leg pad members 10, the five-hole 18 can be moved slightly to the left or the right from the mid-plane at the center of the crease to allow the user to practice both ways.

FIG. 29 is a perspective view that illustrates how increasing the length of the connector 62 on the right, and/or extending the effective length of the right leg pad member relative to the left leg pad member, can be used to shift the five-hole 18 at the apex of the joined-together leg pad members leftward from the mid-plane of the goal space into an offset position pointing off to the left side of the crease. Likewise, increasing the length of the connector 62 on the left, and/or extending the effective length of the left leg pad member relative to the right leg pad member, can be used to shift the five-hole 18 at the apex of the joined-together pad members rightward from the mid-plane of the goal space into an offset position pointing off to the right side of the crease, thereby enabling the offensive player to practice both ways. The post connectors 62 allow the leg pad members to move freely from side to side. This view once again shows all the available scoring zones on a breakaway, including the five-hole, elevated over-pad areas to the left and right, as well as the scoring openings 28 between the pads and the posts.

FIG. 29A is a perspective view of the third embodiment breakaway trainer of FIG. 5, illustrating the enlarged scoring openings 28 created by the cut-away distal lower corners 24 of the particular leg pad member shapes of that embodiment.

Figure 30:
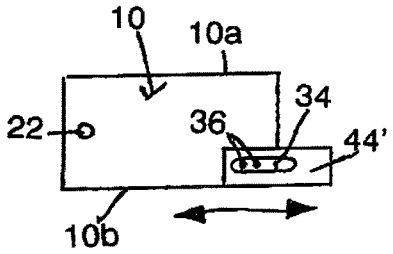
FIG. 30 is a front view of a left pad of a thirteenth embodiment of the breakaway trainer.
Figure 31:
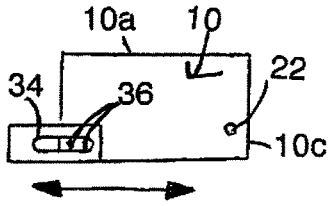
FIG. 31 is a front view of a right pad of the thirteenth embodiment.

FIGS. 30-31 are front views of a thirteenth embodiment in which each leg pad member 10 features a main panel 40' to which an adjustable five-hole blade strip 44' is adjustably mounted for selective horizontal sliding back and forth in the length direction of the main panel to adjust a distance by the five-hole blade strip 44' extends from the proximal end of the main panel. The main panels of the two leg pad members are not pivotally joined by a hinged/flexible connection at their proximal ends, and are instead joined, for example, by a spreader 54 like that of FIG. 21B, which is engaged in clips or loops 58 respectively attached to the backsides of the leg pad members. The five-hole blade strip 44' are like the five-hole panels 44 of FIG. 15, but are of lesser height, each spanning less than half the vertical width of the respective pad member 10, starting from the bottom edge 10*b* thereof.

Figure 30A:
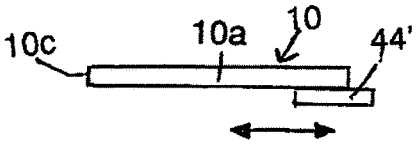
FIG. 30A is a top view of the left pad of FIG. 30.
Figure 31A:
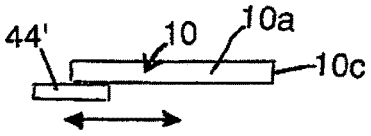
FIG. 31A is a top view of the right pad of FIG. 31.

Using the same type of the horizontally slotted connections 34, 36 described above for the extension panels, five hole flaps and adjustment flaps, each five-hole blade strip 42 can be adjusted to and secured at a selected distance of projection from the end of the respective leg pad member, whereby a user can control the width of a lower five-hole space between the proximal ends of these five-hole blade strips 44', while a wider upper five-hole space remains open above the five-hole blade strips 44' between the main panels of the two leg pad members 10. The user can thus achieve more complex five-hole shapes than in other embodiments. This for example can be used to simulate a situation where a goalie's stick blade partially covers the bottom of the five-hole from one side thereof, while leaving a gap open at the bottom of the five hole between the tip of the stick blade and the other pad. Such a scenario can be emulated by fully or partially extending one five-hole blade strip 44' from its respective leg pad member, while leaving the other five-hole blade strip 44' fully retracted from the proximal end of its respective leg pad member. By such adjustment of the five-hole blade strips 44' from side to side as shown by the arrows, this allows for the five-hole to be adjusted to the user's skill set. FIGS. 30A and 31A are top views showing the direction the five-hole blade strips' adjustability. They can be adjusted left or right to allow the users to hone their five-hole placement skills by making the five-hole smaller as desired.

Figure 32:
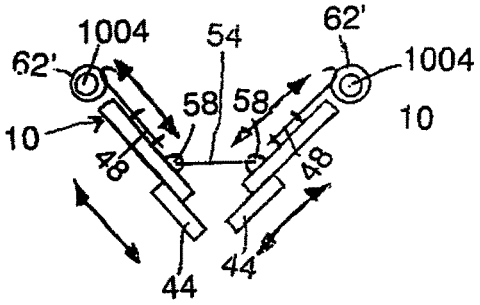
FIG. 32 is a top view of a fourteenth embodiment of the breakaway trainer that combines features from the thirteenth, twelfth and tenth embodiments.

FIG. 32 is a top view of a fourteenth embodiment illustrating how the same five-hole blade strips 44' of FIGS. 30-31 can be used for five-hole adjustment regardless of whether the main panels of the leg pad members 10 are connected to the goal posts 1004 through connection holes 22 (FIGS. 30-31), or via extension rods 48 (FIG. 32).

Figure 33:
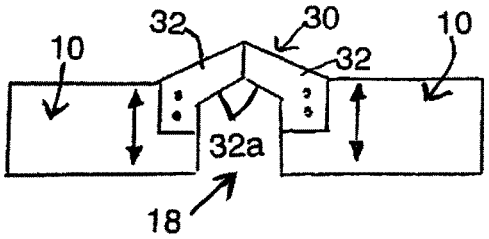
FIG. 33 is a front view of a fifteenth embodiment of the breakaway trainer.

FIG. 33 is the front view of a fifteenth embodiment with the same five-hole attachment 30 as FIG. 9, but lacking the five-hole cutouts 12 and the underlying blade portions 14 of the leg pad members 10 that span across the bottom of the five-hole opening 18 in the FIG. 9 embodiment. Instead of the stepped shape at the proximal end of each leg pad member that defines the five-hole cutout 12 and underlying blade portion 14 in other embodiments, each leg pad member 10 instead terminates in a vertically upright straight edge at its proximal end, and each five-hole piece 32 is attached to its respective leg pad member 10 by a slotted connection adjacent this straight upright edge. The two leg pad members 10 are pivotally connected only by the hinged/flexible connection 16' of the five-hole attachment 30, and are otherwise horizontally spaced apart to create an open-bottomed five hole opening 18 that spans from ground/ice level up to the five-hole attachment 30 that defines the upper boundary of the five hole opening. As described earlier, the five-hole attachment can be adjustably mounted for upward and downward movement to adjust the height of the five-hole opening 18, as shown by the double headed arrows in the drawing.

All parts of the breakaway trainer can be made from plastics, plywood or other suitably robust materials that can withstand the shot of hockey puck or other hard projectile. The pad system can be made in different sizes to mimic the life size pads of any goaltender. As described above, elongated slot-shaped holes or sets of selectively alignable holes can be included for various adjustments, including five-hole height, width and/or shape adjustment, leg pad length adjustment, pad stacking height or lateral position adjustment, etc. Additional holes can be drilled, cast or molded in place for to accommodate a carrying handle, connection of the post connectors, and/or other adjustments.

Figure 34A:
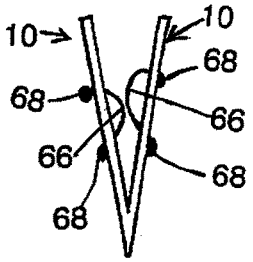
FIG. 34A is a top view of the sixteenth embodiment.
Figure 34:
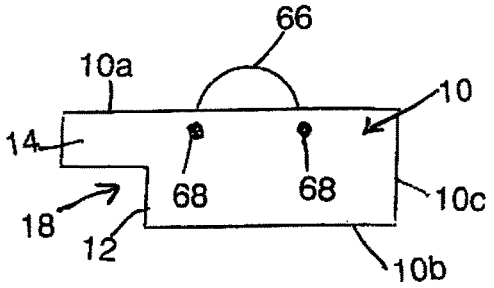
FIG. 34 is a side elevational view of a sixteenth embodiment of the breakaway trainer.

FIGS. 34 and 34A illustrate the optional addition of a carry handle to each pad mimicking member, for example in the form of a length of rope 66 whose opposing ends are threaded through a pair of horizontally spaced mounting holes in the respective pad member, before attaching or forming an enlargement 68 (e.g. end fitting, or tied knot) at each end to prevent the end of the rope from being pulled back through the respective mounting hole in the leg pad member. Each rope thus forms a carrying handle loop that can be brought together by pivotally collapsing the leg pad members toward one another, as shown in FIG. 34A to enable convenient one handed carrying of both loops so that the leg pad members don't swing apart from one another. The extension rods or extension strips can be made from any type of hard steel or other materials that can withstand a hard projectile. The post connections can be made of various materials such as Velcro™ hook and loop fabric, rope, adjustable webbing straps or other similar or suitable materials. The clips or other hardware for supporting and selectively locking the rod extensions to the pads can be of any type suitable of withstanding impact by hockey pucks or other hard projectiles without detriment to their ongoing operability.

The forgoing embodiments thus provide a breakaway trainer with a three-dimensional aspect mimicking the leg pads of a goaltender, while extensions and/or adjustable connectors allows the trainer to be quickly moved from side to side and forward and backward to simulate various goalie positions for breakaway practice. This allows the user to practice all dekes and moves. Optional inclusion of an adjustable five hole or end scoring hole to allow for users of all ages to practice at their skill level with the appropriate hole size. The pads can also have pad stacking attachments added to mimic even more goalie type situations. These attachments may include a glove and a blocker which a user will find above the pads during a breakaway.

While the illustrated embodiments employ connections to the goal posts to secure the breakaway trainer in the useful position in front of the goal net with the leg pad members in convergent relation to one another, other embodiments may use other connections to secure the breakaway trainer in the useful position, for example connections to the cross-bar of the goal frame, to a back-bar of the goal frame, to the mesh of the goal frame, or to the ice or other playing surface itself. For example, spikes or weights at the ends of the pad mimicking members may be used to gravitationally and frictionally hold the breakaway trainer in place.

The breakaway trainer can also be used for the following offensive play techniques:

- One timers form either the left or right side of the device as the player must raise the projectile above the leg pad members and miss the glove/blocker attachment, if used, or aim the projectile through the end hole near the pad and the post.
- The user can perform wrap-arounds from behind the net, or attacks from either side.
- The user can perform deflections that must go over the pads or miss the glove/blocker attachments.
- The user can practice the five-hole shot from anywhere on the playing surface using various shot options.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A breakaway trainer device comprising:

a first leg pad mimicking member;

a second leg pad mimicking member residing in or movable into a position lying at a convergent angle with said first leg pad, where each of said leg pad mimicking members has a width and length approximating that of a goalie leg pad;

a pivotal, flexible or adjustable connection between said first and second leg pad mimicking members by which the converging angle can be varied, whereby the breakaway trainer is useful in front of a goal net with the first and second leg pad mimicking members in positions projecting outward from the goal net at different converging angles with one another to simulate different goalie positions for breakaway practice; and first and second extensions each movably mounted to a respective one of the first and second leg pad mimicking members and selectively extendable therefrom to adjust an overall length of said respective one of the first and second leg pad mimicking members.

2. The device of claim 1 comprising first and second connectors operable to respectively connect the first and second leg pad mimicking members to first and second posts of said goal net.

3. The device of claim 2 wherein the first and second connectors are each adjustable in length to enable variability in (i) a distance by which said first and second leg pad mimicking members project outward from the goal net, and/or (ii) the relative angle between the first and second leg pad mimicking members.

4. The device of claim 3 wherein the first and second connectors comprise adjustable straps.

5. The device of claim 4 wherein the first and second connectors are adjustable straps with hook and loop fastener material.

6. The device of claim 1 wherein the extensions are narrower than the leg pad mimicking members and are coupled thereto in elevated positions spaced upwardly from bottom edges of said leg pad mimicking members to leave an opening between each leg pad mimicking member and the respective post of the goal net beneath the respective extension.

7. The device of claim 1 wherein each extension is strip-shaped.

8. The device of claim 6 wherein the first and second extensions have respective slotted connections to the first and second leg pad mimicking members.

9. The device of claim 1 wherein each goalie mimicking pad has a cut-out therein at a lower corner of a distal end of the goalie mimicking pad to leave an open scoring hole between the goalie mimicking pad and a respective post of the goal net at said lower corner of the goalie mimicking pad.

10. The device of claim 9 comprising a respective adjustment flap movably supported on each goalie mimicking pad adjacent the cut-out at the lower corner thereof, said adjustment flap being movable back and forth over the cut-out to adjust a size of the open scoring hole.

11. The device of claim 1 comprising a five-hole opening between the first and second leg pad mimicking members above the connection at which the first and second leg pad mimicking members are joined.

12. The device of claim 1 comprising a five-hole opening between the first and second leg pad mimicking members below the connection at which the first and second leg pad mimicking members are joined.

13. The device of claim 11 comprising a five-hole attachment attachable to the first and second leg pad mimicking members to span over the five-hole opening.

14. The device of claim 13 wherein the five-hole attachment is adjustably mountable to the first and second leg pad mimicking members for selectively upward and downward movement thereof to adjust a height of the five-hole opening.

15. The device of claim 1 comprising one or more pad stacking attachments connected or connectable to the first and/or second leg pad mimicking members in positions standing upward from said pad mimicking members.

16. The device of claim 15 wherein said one or more pad stacking attachments are adjustable to vary a height by which, or location at which, they span upwardly from the first and second leg pad mimicking members.

17. The device of claim 1 in combination with the goal net, wherein the first and second leg pad mimicking members project outwardly from the goal net at said converging angle to one another.

18. The device of claim 2 in combination with the goal net, wherein the first and second leg pad mimicking members project outwardly from the goal net at said converging angle to one another, one of the first and second connectors has a greater effective length than the other of said first and second connectors, and the first and second leg pad mimicking members reside at different angles to the goal net and point in an off-center direction from said goal net.

19. The device of claim 17 wherein the one of the first and second leg pad mimicking members is greater in said overall length than the other of said first and second leg pad mimicking members, and the first and second leg pad mimicking members reside at different angles to the goal net and point in an off-center direction from said goal net.

20. The device of claim 1 wherein at least one of the first and second extensions comprises a respective extension rod having a ring at a distal end thereof through which a separate connector can be coupled to a respective post of said goal net.

* * * * *